US006230818B1

(12) United States Patent
Slunder

(10) Patent No.: US 6,230,818 B1
(45) Date of Patent: May 15, 2001

(54) ADJUSTABLE DRAWBAR AND CIRCLE SUPPORT ASSEMBLY FOR A MOTOR GRADER

(75) Inventor: Jeff Slunder, Decatur, IL (US)

(73) Assignee: Caterpillar, Inc., Peoria, IL (US)

( * ) Notice: Subject to any disclaimer, the term of this patent is extended or adjusted under 35 U.S.C. 154(b) by 0 days.

(21) Appl. No.: 09/357,447

(22) Filed: Jul. 20, 1999

(51) Int. Cl.[7] ..... E02F 3/76
(52) U.S. Cl. ..... 172/789; 172/797
(58) Field of Search ..... 172/789, 797, 172/795; 280/482

(56) References Cited

U.S. PATENT DOCUMENTS

| | | | | |
|---|---|---|---|---|
| 918,633 | | 4/1909 | Wold . | |
| 1,247,719 | | 11/1917 | Reese . | |
| 1,811,490 | * | 6/1931 | Brown | 172/789 |
| 3,014,738 | | 12/1961 | Kasten | 280/482 |
| 3,116,076 | | 12/1963 | Zingsheim | 280/482 |
| 3,763,938 | * | 10/1973 | Brodersen | 172/789 |
| 3,856,089 | | 12/1974 | Rivinius | 172/789 X |
| 4,071,090 | | 1/1978 | Easterling . | |
| 4,213,507 | | 7/1980 | Horrer et al. . | |
| 4,403,670 | | 9/1983 | Sammarco | 280/482 X |
| 4,611,821 | | 9/1986 | Jeanson et al. | 280/482 |
| 5,217,242 | | 6/1993 | Thomas | 280/482 |
| 5,411,102 | | 5/1995 | Nickels et al. . | |
| 5,782,016 | | 7/1998 | Feller et al. . | |

FOREIGN PATENT DOCUMENTS 204742 10/1967 (SU) .

* cited by examiner

*Primary Examiner*—Christopher J. Novosad
(74) *Attorney, Agent, or Firm*—Wood, Herron & Evans, LLP

(57) ABSTRACT

A motor grader is provided with an adjustable drawbar and circle support assembly. The assembly includes a circle support for mounting a moldboard or blade for rotation about an upright axis, and an extensible and retractable drawbar having one end associated with the circle support and another end adapted for pivotal connection to the main frame of the motor grader. The drawbar is preferably hydraulically actuatable to move the circle support fore and aft along the longitudinal length of the motor grader main frame to provide longitudinal adjustment of the grader blade.

15 Claims, 1 Drawing Sheet

ADJUSTABLE DRAWBAR AND CIRCLE SUPPORT ASSEMBLY FOR A MOTOR GRADER

TECHNICAL FIELD

The present invention relates generally to coupling and mounting mechanisms and, more particularly, to a blade mounting assembly for mounting a ground engaging moldboard or blade of a motor grader.

BACKGROUND ART

Work machines, such as motor graders, are used for geographic surface altering operations. Motor graders include a work implement, such as a surface altering blade or moldboard, that is movably connected to a main frame of the motor grader. Typically, the motor grader blade is suspended from the main frame by means of a drawbar and circle support assembly. The assembly has a forward end connected to the front of the motor grader main frame by a ball and socket connection, while the rearward portion of the assembly is suspended from the main frame by hydraulic actuators which permit the assembly to swing in a vertical plane about its front end. The grader blade is mounted to a circle through blade supports, and the circle is mounted for rotation relative to the drawbar and circle support assembly about an upright axis to allow an operator to locate the grader blade in an appropriate angular position relative to the assembly for performing various work functions.

In the past, while the position of the grader blade was angularly adjustable about an upright axis through rotation of the circle, and further adjustable in a vertical plane through swinging movement of the drawbar and circle support assembly about its forward end, the fore and aft longitudinal position of the grader blade relative to the motor grader main frame was fixed.

However, those skilled in the art will appreciate that the longitudinal position of the grader blade relative to the main frame is critical to the proper function of the blade in a grading operation over a relatively wide range of motor grader speeds. As motor grader speed is increased beyond a certain limit in a grading operation, it is possible that the forces acting on the grader blade may cause the work machine to bounce and the grader blade to scallop the road surface. Moreover, the fixed longitudinal position of the grader blade limits blade reach and positioning capabilities, as well as limiting the ability of the operator to align the blade with other machine implements that are mounted to the motor grader.

The present invention is directed to overcoming one or more of the problems as set forth above.

DISCLOSURE OF THE INVENTION

The present invention overcomes the foregoing and other shortcomings and drawbacks of motor grader drawbar and circle support assemblies heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, an adjustable drawbar and circle support assembly for a motor grader is provided. The assembly includes a rearwardly positioned circle support that is adapted for mounting a circle and blade thereto for rotation about an upright axis. The assembly further includes a forwardly positioned hydraulically extensible and retractable drawbar having one end associated with the circle support and another end adapted for pivotal connection to a main frame of a motor grader. The circle support is adapted for fore and aft movement along a longitudinal axis of the motor grader main frame by hydraulic extension and retraction of the drawbar.

In accordance with one aspect of the present invention, the drawbar comprises a hydraulic actuator including a hydraulic cylinder and an extensible and retractable piston rod. One end of the hydraulic cylinder is associated with a forward end of the circle support. The forward end of the piston rod is adapted for pivotal connection to the motor grader main frame.

In accordance with another aspect of the present invention, the drawbar comprises a first drawbar member having one end associated with a forward end of the circle support, and a second drawbar member in telescoping relationship with the first drawbar member. The forward end of the second member is adapted for pivotal connection to the motor grader main frame. A hydraulic actuator is associated with the first and second drawbar members for extending and retracting the first and second drawbar members relative to each other to move the circle support fore and aft along the longitudinal axis of the motor grader main frame.

The above and other objects, features and advantages of the present invention will become apparent from the following description and the attached drawings.

BRIEF DESCRIPTION OF THE DRAWINGS

For a better understanding of the present invention, reference may be made to the accompanying drawings in which.

BEST MODE FOR CARRYING OUT THE INVENTION

Figure 1:
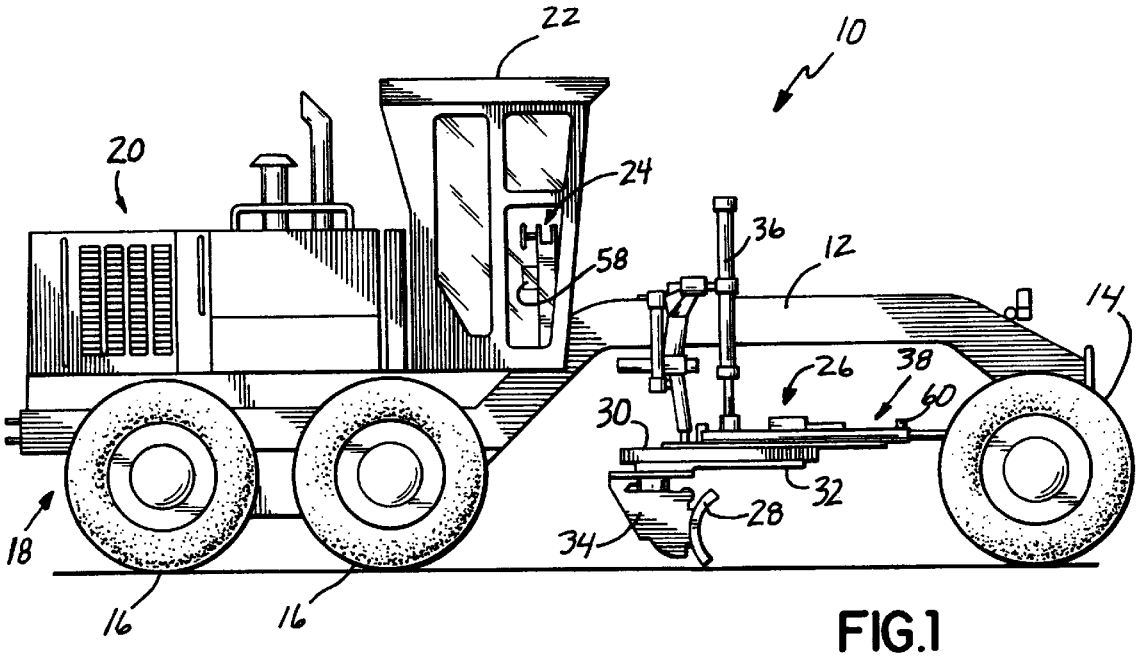
FIG. 1 is a side view of a motor grader incorporating an adjustable drawbar and circle support assembly in accordance with the principles of the present invention.

With reference to the figures, and to FIG. 1 in particular, an article of construction machinery 10 in the form of a motor grader is shown. Motor grader 10 includes a longitudinal main frame 12 that is supported at its forward end with steering wheels 14, and at its rear portion with power drive wheels 16 that are driven by a traction chassis, indicated generally at 18, and a power plant, indicated generally at 20. An operator's cab 22 is positioned forwardly of the traction chassis 18 wherein operator controls, shown generally at 24, are provided for controlling movement and operation of the motor grader 10. As will be described in more detail below, a drawbar and circle support assembly, shown generally at 26, is supported for movement relative to the main frame 12 so that assembly 26 can be selectively moved by an operator to perform a desired geographic surface altering cut with a ground engaging moldboard or blade 28.

Figure 2:
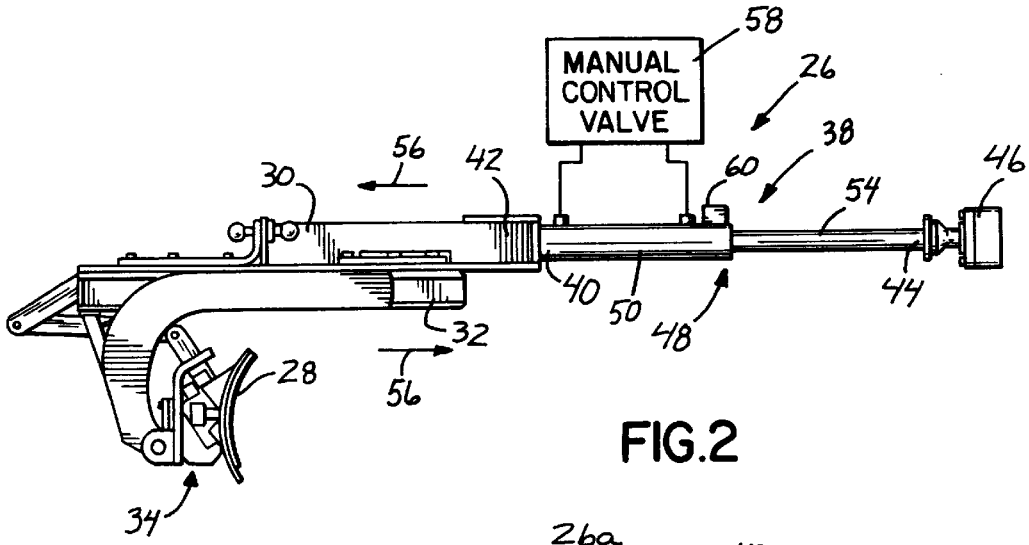
FIG. 2 is a side elevational view of the drawbar and circle support assembly shown in FIG. 1.

Referring now to FIGS. 1 and 2, drawbar and circle support assembly 26 includes a rearward circle support 30 that rotatably supports a circle 32 and the ground engaging blade 28 that is mounted to the circle 32 through conventional blade supports 34. Circle 32 and blade 28 are rotatable about an upright axis (not shown) through conventional circle motor controls so that the toe and heel positions of the blade 28 can be set relative to the longitudinal axis of the main frame 12. Conventional hydraulic actuators or lifts 36 are mounted on each side of the motor grader main frame 12 and mount to opposite sides of the circle support 30. The lifts 36 raise and lower the opposite sides of the circle support 30 so that a transverse slope can be established for the ground engaging blade 28 as is known in the art. As the substantial structure of the circle support 30, circle 32, blade supports 34, blade 28 and lifts 36 are generally all conventional in the field of motor graders, they are not shown or described in detail herein.

Still referring to FIGS. 1 and 2, the drawbar and circle support assembly 26 includes an extensible and retractable drawbar 38 having one end 40 either integral with or connected to a forward end 42 of circle support 30, and another end 44 pivotally connected to the main frame 12. Drawbar end 44 preferably terminates in a spherical bearing assembly 46 that mounts to the forward end of main frame 12 to provide articulated motion of the assembly 26 relative to the main frame 12. Of course, other structures are possible for pivotally connecting drawbar end 44 to the main frame 12 for providing articulated motion of the assembly 26 as will be appreciated by those of ordinary skill in the art.

In accordance with one aspect of the present invention, as best understood with reference to FIG. 2, extensible and retractable drawbar 38 takes the form of a hydraulic actuator 48 including a cylinder housing 50 having end 40 either integral with or connected to the forward end 42 of the circle support 30. An extensible and retractable piston rod 54 is mounted within the cylinder housing 50 and includes the spherical bearing assembly 46 mounted either integrally with or connected to the forward end 44 of the drawbar piston rod 54. While not shown, it will be appreciated that a reservoir of hydraulic fluid (not shown) and a pump (not shown) are associated with the hydraulic actuator 48 to effect continuous extension or retraction of the piston rod 54 as will be appreciated by those of ordinary skill in the art. As used herein, the term "continuous" denotes that the piston rod 54 is generally infinitely variably postionable along the length of its stroke.

As the forward end 44 of the drawbar piston rod 54 is longitudinally fixed relative to the main frame 12, it will be appreciated that as the piston rod 54 is extended or retracted relative to the cylinder housing 50, the circle support 30, circle 32, and cutting blade 28 will move fore and aft, represented by arrows 56, along the longitudinal axis of the motor grader main frame 12. The continuous extension and retraction of piston rod 54 thus provides a very accurate longitudinal positioning of the ground engaging blade 28 relative to the main frame 12. It is contemplated that fore and aft movement of the circle support 30 in the range of about one foot should be sufficient to provide advantageous control of the forces exerted on blade 28 during a geographic surface altering operation, as well as improve blade match up with other machine implements and an increase blade position envelope. Of course, those skilled in the art will appreciate that longitudinal movement of the circle support 30 in greater or lesser ranges are possible without departing from the spirit and scope of the present invention.

The extension and retraction of piston rod 54 is preferably manually controlled by an operator through a manual control valve or actuator 58 (FIGS. 1 and 2) that is preferably mounted within the operator's cab 22 and fluidly connected to the hydraulic system (not shown) associated with the assembly 26. In this way, the longitudinal positioning of the circle support 30 relative to the main frame 12 is remotely controllable by the operator so that adjustments to the longitudinal position of blade 28 may be easily made by the operator from within the cab 22.

The drawbar and circle support assembly 26 preferably includes a sensor 60 that is operable to detect movement of the piston rod 54 relative to the cylinder housing 50 for providing an operator with a position indication of at least part of the assembly 26 relative to the main frame 12. The position data or indicia may simply be the relative position of the piston rod 54 and cylinder housing 50 from which the position of assembly 26 relative to the main frame 12 can be determined. Alternatively, it is contemplated that the position data or indicia may take the form of numerical or pictorial data that represents the instant longitudinal position of the assembly 26, a part thereof, or blade 28 relative to the main frame 12. To this end, a display (not shown) may be provided in the operator's cab 22 to provide operator identifiable data of the longitudinal position of assembly 26, a part thereof, or blade 28 to the operator within the cab 22. Those skilled in the art will readily appreciate the multitude of sensor devices that are possible for achieving this function in accordance with the principles of the present invention. Moreover, while sensor 60 is illustrated as being mounted on a part of drawbar 38, it will be appreciated that sensor 60 may be mounted within a part of drawbar 38 or mounted to main frame 12 depending on the type of sensor device used and the sensing method employed.

Figure 3:
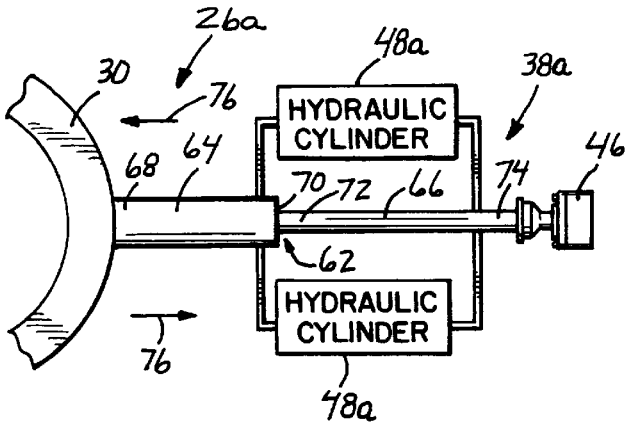
FIG. 3 is a partial diagrammatic view of a drawbar and circle support assembly in accordance with an alternative embodiment of the present invention.

Referring now to FIG. 3, a drawbar and circle support assembly **26*a* in accordance with an alternative embodiment of the present invention is shown where like numerals refer to like parts in the assembly 26 of FIGS. 1 and 2. In this embodiment, drawbar 38*a* takes the form of a telescoping drawbar member 62 including a first hollow cylindrical member 64 and a second member 66 that is mounted in telescoping relationship with the first member 64 for operator selected extension and retraction relative to the first member 64. First member 64 has one end 68 either integral with or connected to the forward end of circle support 30, and an open end 70 that is adapted to slidably receive the second member 66. While not shown, it will be appreciated that telescoping second member 66 includes a ferrule or similar structure near one end 72 that is received within the first member for guiding the second member 66 within first member 64. The forward end 74 of second member 66 preferably includes spherical bearing assembly 46 that mounts to the forward end of main frame 12 to provide articulated motion of the assembly 26*a* relative to the main frame 12** as described in detail above.

Further referring to FIG. 3, one or more hydraulic actuators **48*a* (two shown) are mounted to the assembly 26*a* to provide operator selected extension and retraction of the second member 66 relative to the first member 64. While not shown, it will be appreciated that a manual control valve or actuator 58 (FIGS. 1 and 2) and a hydraulic system (not shown) as described in detail above are provided to effect continuous extension or retraction of the second member 66 as will be appreciated by those of ordinary skill in the art. The hydraulic actuators 48*a* may have respective opposite ends mounted to the first and second members 64, 66 through mounting collars (not shown), although those skilled in the art will appreciate the multitude of mounting structures and methods that are possible for providing hydraulic extension and retraction of the second member 66** without departing from the spirit and scope of the present invention.

As the forward end 74 of the drawbar second member 66 is longitudinally fixed relative to the main frame 12, it will be appreciated that as the second member 66 is extended or retracted relative to the first member 64, the circle support 30, circle 32, and cutting blade 28 will move fore and aft, represented by arrows 76, along the longitudinal axis of the motor grader main frame 12. While not shown, it will be appreciated that a sensor, similar or identical to sensor 60 (FIGS. 1 and 2), may be associated with the assembly 26*a* to provide the operation with position data or indicia of assembly 26*a* as described in detail above.

Of course, it will be readily appreciated that while hydraulic actuators 48, 48*a* may be preferred for moving either assembly 26, 26*a* fore and aft along the longitudinal axis of main frame 12, other power-assisted actuators and actuating devices are possible without departing from the spirit and scope of the present invention. Those skilled in the art will appreciate the multitude of actuators or actuating devices that will achieve the desired function of moving either assembly 26, 26*a* fore and aft as described in detail above.

INDUSTRIAL APPLICABILITY

With reference to the drawings and in operation, the operator of the motor grader 10 sets the desired position of blade 28 for a geographic surface altering cut through controls 24 located within the cab 22. The longitudinal position of either assembly 26, 26*a* relative to main frame 12 is remotely adjusted by the operator from within the cab 22 through manual control valve or actuator 58 (FIGS. 1 and 2) that is also preferably located within the cab 22. As the piston rod 54 of assembly 26, or the second member 66 of assembly 26*a*, is extended or retracted through operation of hydraulic actuator 48 or actuators 48*a*, the longitudinal position of either assembly 26, 26*a* relative to main frame 12 is conveniently and accurately controlled by the operator. It will be readily appreciated by those skilled in the art that the adjustment provided by the extensible and retractable drawbars 38, 38*a* increases the blade position envelope by increasing blade reach and positioning. Adjustable drawbars 38, 38*a* also improve control over blade down force so that by moving the blade 28 longitudinally fore and aft of the main frame 12, the operator can decrease or increase the blade down force as desired. Adjustable drawbars 38, 38*a* further improve blade match up or alignment with other machine attachments. Moreover, the adjustable drawbars 38, 38*a* improve overall motor grader productivity by allowing the operator to operate at higher speeds without undesirable blade scalloping and machine bounce.

Other aspects, objects and advantages of the present invention can be obtained from a study of the drawings, the disclosure and the appended claims.

What is claimed is:

1. An adjustable drawbar and circle support assembly for a motor grader, comprising:

a circle support adapted for mounting a blade thereto for rotation about an upright axis; and a hydraulically extensible and retractable drawbar having one end associated with said circle support and another end adapted for pivotal connection to a main frame of a motor grader, said drawbar being extensible and retractable along its longitudinal axis, whereby said circle support is adapted for fore and aft movement along a longitudinal axis of the motor grader main frame by hydraulic extension and retraction of said drawbar.

2. The assembly of claim 1, wherein said drawbar comprises a hydraulic actuator including a hydraulic cylinder having one end associated with said circle support and an extensible and retractable piston rod having one end adapted for pivotal connection to the motor grader main frame.

3. The assembly of claim 1, wherein said drawbar comprises:

a first drawbar member having one end associated with said circle support;

a second drawbar member in telescoping relationship with said first drawbar member and having one end adapted for pivotal connection to the motor grader main frame; and a hydraulic actuator associated with said first and second drawbar members for extending and retracting said first and second drawbar members relative to each other to move said circle support fore and aft along the longitudinal axis of the motor grader main frame.

4. The assembly of claim 1, further comprising a manually operable actuator associated with said drawbar to provide operator selected hydraulic extension and retraction of said drawbar.

5. The assembly of claim 1 further comprising a sensor associated with at least one of said circle support and said drawbar to provide an indication to an operator of the position of at least part of said assembly relative to said motor grader main frame.

6. An adjustable drawbar and circle assembly for a motor grader, comprising:

a circle support adapted for mounting a blade thereto for rotation about an upright axis;

an extensible and retractable drawbar having one end associated with said circle support and another end adapted for pivotal connection to a main frame of a motor grader, said drawbar being extensible and retractable along its longitudinal axis; and a manually operable actuator located remote from said drawbar and circle support to provide operator selected extension and retraction of said drawbar, whereby said circle support is adapted for fore and aft movement along a longitudinal axis of the motor grader main frame by remote operator selected extension and retraction of said drawbar.

7. The assembly of claim 6, wherein said drawbar comprises a hydraulic actuator including a hydraulic cylinder having one end associated with said circle support and an extensible and retractable piston rod having one end adapted for pivotal connection to the motor grader main frame.

8. The assembly of claim 6, wherein said drawbar comprises:

a first drawbar member having one end associated with said circle support;

a second drawbar member in telescoping relationship with said first drawbar member and having one end adapted for pivotal connection to the motor grader main frame; and a hydraulic actuator associated with said first and second drawbar members for extending and retracting said first and second drawbar members relative to each other to move said circle support fore and aft along the longitudinal axis of the motor grader main frame.

9. The assembly of claim 6 further comprising a sensor associated with at least one of said circle support and said drawbar to provide an indication to an operator of the position of at least part of said assembly relative to the motor grader main frame.

10. A motor grader, comprising:

a moveable main frame including steering wheels proximate a front end thereof and power drive wheels, a traction chassis and a power plant proximate a rear end thereof;

an operator's cab supported on said main frame forward of said traction chassis;

a circle support mounted for movement relative to said main frame and adapted for mounting a blade thereto for rotation about an upright axis;

an extensible and retractable drawbar having one end associated with said circle support and another end pivotally connected to said main frame, said drawbar being extensible and retractable along its longitudinal axis; and a manually operable actuator located within said operator's cab to provide operator selected extension and retraction of said drawbar, whereby said circle support is adapted for fore and aft movement along a longitudinal axis of said motor grader main frame by operator selected extension and retraction of said drawbar from within said operator's cab.

11. The motor grader of claim 10, wherein said drawbar comprises a hydraulic actuator including a hydraulic cylinder having one end associated with said circle support and an extensible and retractable piston rod having one end pivotally connected to said motor grader main frame.

12. The motor grader of claim 10, wherein said drawbar comprises:

a first drawbar member having one end associated with said circle support;

a second drawbar member in telescoping relationship with said first drawbar member and having one end pivotally connected to said motor grader main frame; and a hydraulic actuator associated with said first and second drawbar members for extending and retracting said first and second drawbar members relative to each other to move said circle support fore and aft along the longitudinal axis of said motor grader main frame.

13. The motor grader of claim 10 further comprising a sensor associated with at least one of said circle support and said drawbar to provide an indication to an operator of the position of at least part of said assembly relative to said motor grader main frame.

14. A method of adjusting a drawbar and circle support assembly of a motor grader, comprising:

mounting a drawbar and circle support assembly for movement relative to a main frame of a motor grader;

moving said circle support fore and aft along a longitudinal axis of the motor grader main frame by remote operator selected extension and retraction of said drawbar along its longitudinal axis.

15. The method of claim 14 further comprising hydraulically extending and retracting said drawbar.

* * * * *